United States Patent [19]

Ullman

[11] 4,416,481

[45] Nov. 22, 1983

[54] BOTTLE CARRIER

[75] Inventor: Myron E. Ullman, Canfield, Ohio

[73] Assignee: Kessler Products Co., Inc., Youngstown, Ohio

[21] Appl. No.: 250,085

[22] Filed: Apr. 1, 1981

[51] Int. Cl.[3] ..... B65D 71/00

[52] U.S. Cl. ..... 294/87.2

[58] Field of Search ..... 294/87.2, 87.28, 87 R, 294/31.2; 206/139, 156, 158, 160, 169, 427, 428, 620, 628, 636, 446; 215/106 A

[56] References Cited

U.S. PATENT DOCUMENTS

| | | | |
|---|---|---|---|
| 2,650,128 | 8/1953 | Failor | 294/87.2 |
| 2,803,487 | 8/1957 | Dalton | 294/87.2 |
| 3,036,853 | 5/1962 | Glazer | 294/87.2 |

*Primary Examiner*—James B. Marbert

*Attorney, Agent, or Firm*—David A. Burge Co.

[57] ABSTRACT

A one-piece carrier for supporting a plurality of bottles by their necks in closely spaced, side-by-side relationship has a framework which carries an array of uniformly spaced, neck-receiving formations configured to receive and releasably retain bottle necks to support a plurality of bottles in side-by-side relationship. The neck-receiving formations take the form of an endless band, each having at least one W-shaped portion configured to expand and contract in accordian-like manner to permit other band parts to move relatively toward and away from each other to accommodate insertion of a capped bottle neck through the endless band, and to grip bottle neck portions inserted therethrough. Each of the W-shaped portions is arranged such that its two inner legs engage an inserted bottle neck to assist other parts of the band in gripping the inserted bottle neck. Tapered surfaces carried on lower parts of each of the bands serve to facilitate insertion of bottle necks into the bands.

14 Claims, 9 Drawing Figures

BOTTLE CARRIER

BACKGROUND OF THE INVENTION

1. Field of the Invention

The present invention relates generally to a bottle carrier for engaging the necks of a plurality of bottles to support the bottles in closely spaced, side-by-side relationship.

2. Prior Art

Bottle carriers formed as one-piece structures from molded plastic for engaging the necks of a plurality of bottles to support the bottles for transport are well known. Previously proposed bottle carriers have been characterized by a number of drawbacks including a lack of rigidity, a failure to provide a sufficiently secure support for bottles, a requirement for use of an undesirably large quantity of plastics material in the course of fabrication, an unduly complex configuration requiring expensive molds to manufacture, a construction which renders it difficult to insert bottle necks into the carrier, and/or a configuration which renders it unduly difficult to remove bottles from the carrier.

SUMMARY OF THE INVENTION

The present invention overcomes the foregoing and other drawbacks of prior proposals by providing a novel and improved bottle carrier of relatively simple configuration which requires a minimum of plastics material to form.

Bottle carriers embodying the present invention include a framework which carries an array of uniformly spaced neck-reviewing formations configured to receive and releasably retain bottle necks to support a plurality of bottles in side-by-side relationship. The neck-receiving formations take the form of endless bands, each having at least one W-shaped portion configured to expand and contract in accordian-like manner to permit other band parts to move relatively toward and away from each other. By this arrangement, each of the endless bands can accomodate insertion of a cap-carrying bottle neck therethrough, and serves to grip such bottle neck portions as are inserted therethrough.

The W-shaped portions of the endless bands are formed from two outer legs of material which are interconnected, in series, with a pair of inner legs. The inner legs are arranged in "V" shaped relationship, coming together to form a pointed juncture. This pointed juncture is arranged such that it engages a bottle neck which is inserted through the band, and thereby cooperates with other parts of the band to grip the bottle neck.

Spaced parts of each of the endless bands have tapered bottom portions which facilitate insertion of bottle necks into the bands. These tapered portions are preferably located on band portions which connect with the two outer legs of the W-shaped band parts, whereby the band parts carrying the tapered portions comprise the parts of the band which tend to move most predominately toward and away from each other during bottle neck insertion.

As will be apparent from the foregoing summary, a significant feature of the present invention lies in the provision of endless bands having expansible W-shaped formations for permitting passage through the bands of cap carrying portions of bottle necks, and which cooperate with other band parts to securely grip neck portions of bottles once the neck portions have been inserted into the carrier.

These and other features and a fuller understanding of the invention may be had by referring to the following description and claims taken in conjunction with the accompanying drawings.

DESCRIPTION OF THE PREFERRED EMBODIMENT

Figure 1:
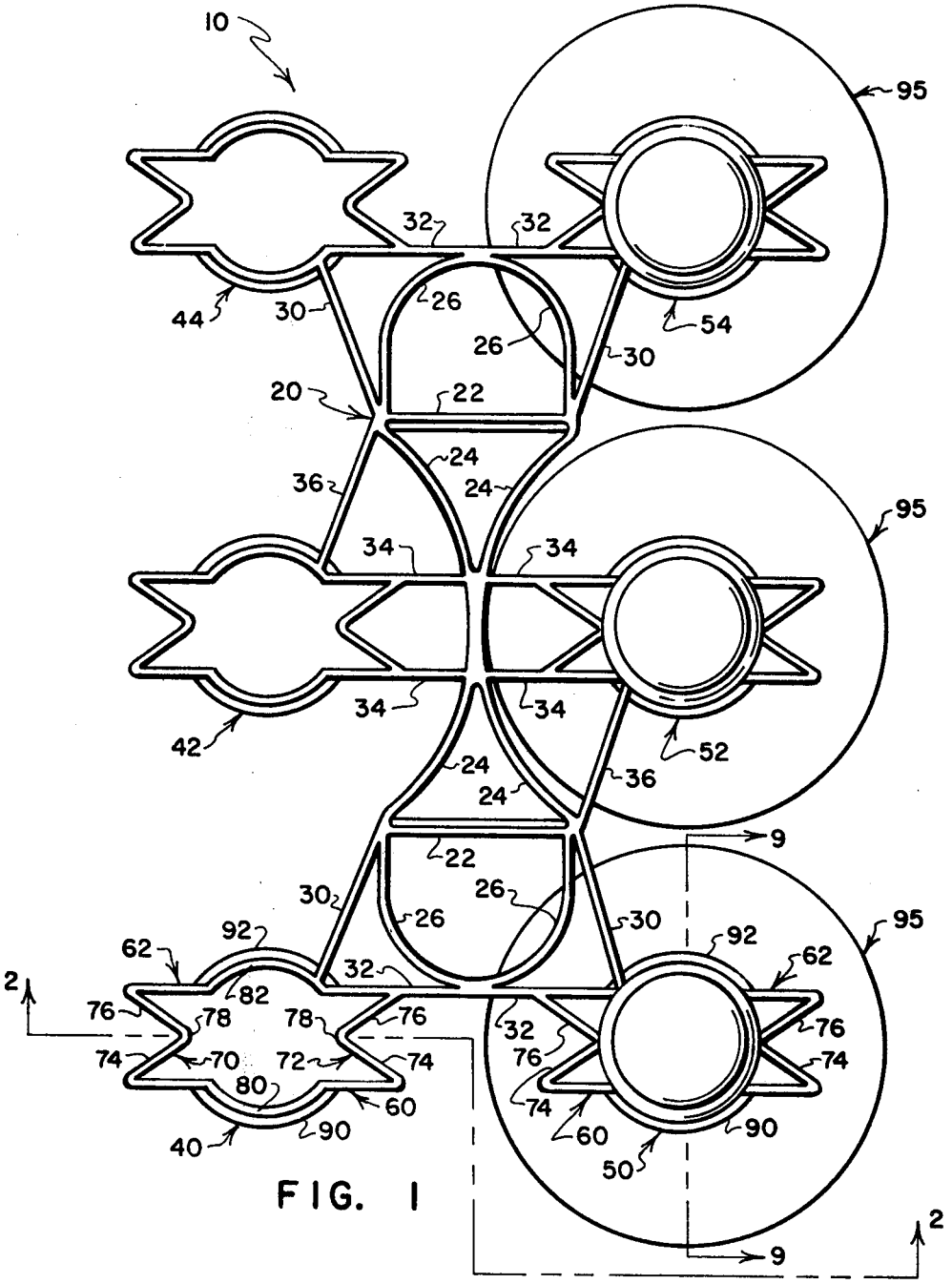
FIG. 1 is a top plan view of one embodiment of a bottle carrier including features of the present invention, the carrier of FIG. 1 being shown engaging a row of three bottles.
Figure 2:
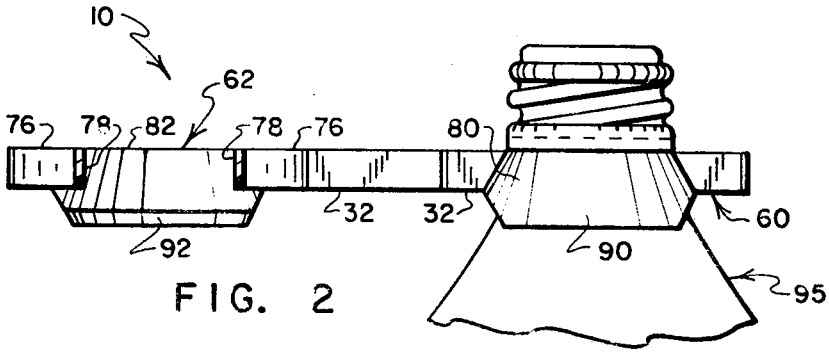
FIG. 2 is a sectional view as seen from planes indicated by the broken line 2—2 in FIG. 1.

Referring to FIGS. 1 and 2, one embodiment of a bottle carrier incorporating features of the present invention is indicated generally by the numeral 10. The carrier 10 is a one-piece structure formed of molded plastics material having a central frame structure indicated generally by the numeral 20, and a plurality of accordian-shaped bottle-neck-receiving formations indicated generally by the numerals 40, 42, 44, 50, 52, 54. Three bottles, each being indicated generally by the numeral 95, are shown with their cap-carrying necks engaged within the neck-receiving formations 50, 52, 54.

The central frame structure 20 is of web-like configuration including a plurality of interconnected bar-like members. Two straight bars 22 and four curvilinear bars 24 cooperate to define an inner frame of generally hourglass configuration. Four curvilinear bars 26 connect with the straight bars 22 and cooperate therewith to define U-shaped openings for receiving the thumb and index finger of a person's hand. Straight bars 30, 32 join with opposite end regions of the curvilinear bars 26 and extend outwardly to connect with the neck-receiving formations 40, 44, 50, 54. Straight bars 34, 36 connect with end regions of the curvilinear bars 24 and extend outwardly to connect with the neck-receiving formations 42, 52.

Each of the neck-receiving formations 40, 42, 44, 50, 52, 54 is of substantially identical configuration and connects in substantially identical fashion with the central frame structure 20. The formations 40, 42, 44 are arranged in uniformly spaced, side-by-side fashion forming a first row. The formations 50, 52, 54 are arranged in uniformly spaced, side-by-side fashion forming a second row which parallels the first row. The formations 40 and 50, 42 and 52, 44 and 54 are arranged respectively side-by-side in rows which perpendicularly intersect the described first and second rows. Thus, the central frame 20 serves the function of supporting the formations 40, 42, 44, 50, 52, 54 in an orderly, uniformly spaced array.

Inasmuch as the formations 40, 42, 44, 50, 52, 54 are substantially identical one with another, only the formation 40 need be described in detail. Referring to FIGS. 1 and 2, the formation 40 includes a pair of substantially parallel legs indicated generally by the numeral 60, 62, and a pair of W-shaped formations 70, 72. The parallel legs 60, 62 and the W-shaped formations 70, 72 cooperate to define an endless band which defines an opening through which a cap-carrying bottle neck may be inserted.

Figure 8:
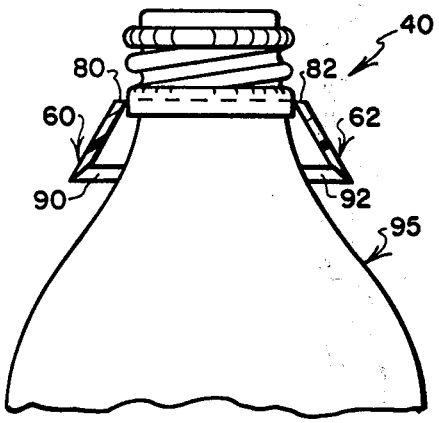
FIG. 8 is a sectional view as seen from a plane indicated by a line 8—8 in FIG. 7; and, FIG. 9 is a sectional view as seen from a plane indicated by a line 9—9 in FIG. 1.

Connection is made between the central frame structure 20 and the formations 40, 42, 44, 50, 52, 54 in such a manner that the central frame structure 20 does not inhibit relative movement between the opposite legs of the formation, whereby such legs as 60, 62 can move relatively away from each other, as is illustrated in FIG. 8, to permit insertion through or removal from the formation 40 of a cap-carrying bottle neck.

Figure 7:
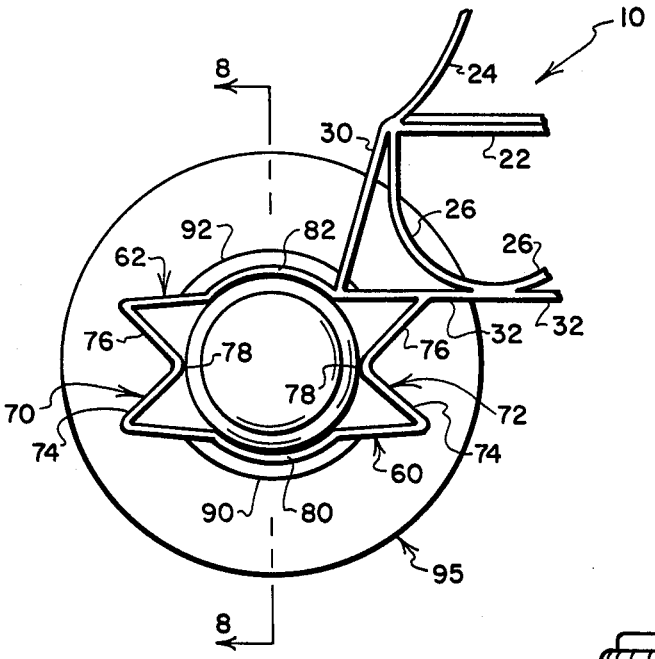
FIG. 7 is a top plan view of a portion of the carrier of FIG. 1, the carrier being shown during insertion of a bottle neck.
Figure 9:
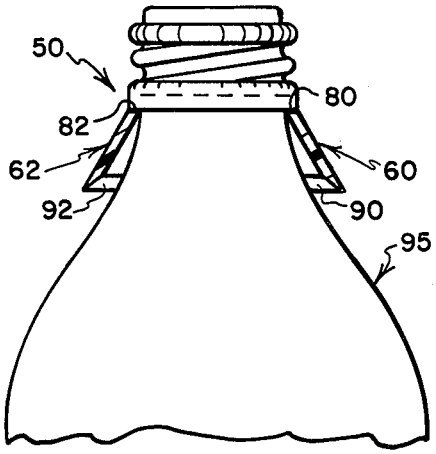

The legs 60, 62 have outwardly convex central portions 80, 82 which serve to center a bottle neck within the formation 40. Lower parts 90, 92 of the convex portions 80, 82 are tapered, as best seen in FIG. 8, to guide and facilitate the insertion of the cap-carrying neck of a bottle 95 into the formation 40. The separation of the portions 80, 82 which takes place when a bottle neck is inserted into the formation 40 as illustrated in FIGS. 7 and 8. The fact that the portions 80, 82 effect a return movement toward each other once relatively large cap-carrying portions of a bottle neck have been inserted therebetween is illustrated in FIGS. 1 and 9.

The W-shaped formations 70, 72 each have outer legs 60, 62, and inner legs 74, 76. The inner legs 74, 76 have inner ends which join to provide V-shaped pointed formations 78. The pointed formations 78 are spaced apart by a distance which is slightly less than the outer diameter of the bottle neck portion to be retained therebetween, whereby the pointed formations 78 serve to securely grip a bottle neck portion inserted therebetween. By virtue of this gripping action, the W-shaped formations 70, 72 not only cooperate with the legs 60, 62 to grip and securely retain a bottle in the carrier 10, but also serve to tension the material of the legs 60, 62 to enhance their gripping action.

The W-shaped formations are expansible and contractible, in the manner of an accordian, to accommodate relative movement between the legs 60, 62 during insertion of a bottle neck therebetween. The W-shaped formations also accommodate relative movement of the V-shaped pointed formations 78 as is needed during bottle neck insertion. The "memory" of the plastics material from which the carrier 10 is formed biases the components of the neck-receiving formations 40, 42, 44, 50, 52, 54 toward their "normal" positions as illustrated in the showings of the formations 40, 42, 44 in FIG. 1.

In preferred practice the upper surfaces of the legs 60, 62, 74, 76 extend in a plane which is common to the upper surfaces of the bars 22, 24, 26, 30, 32, 34, 36. The upper surfaces of the legs 60, 62, 74, 76 are particularly well suited to underlie and engage the bottom skirt edge of caps carried on the bottles 95.

Figure 3:
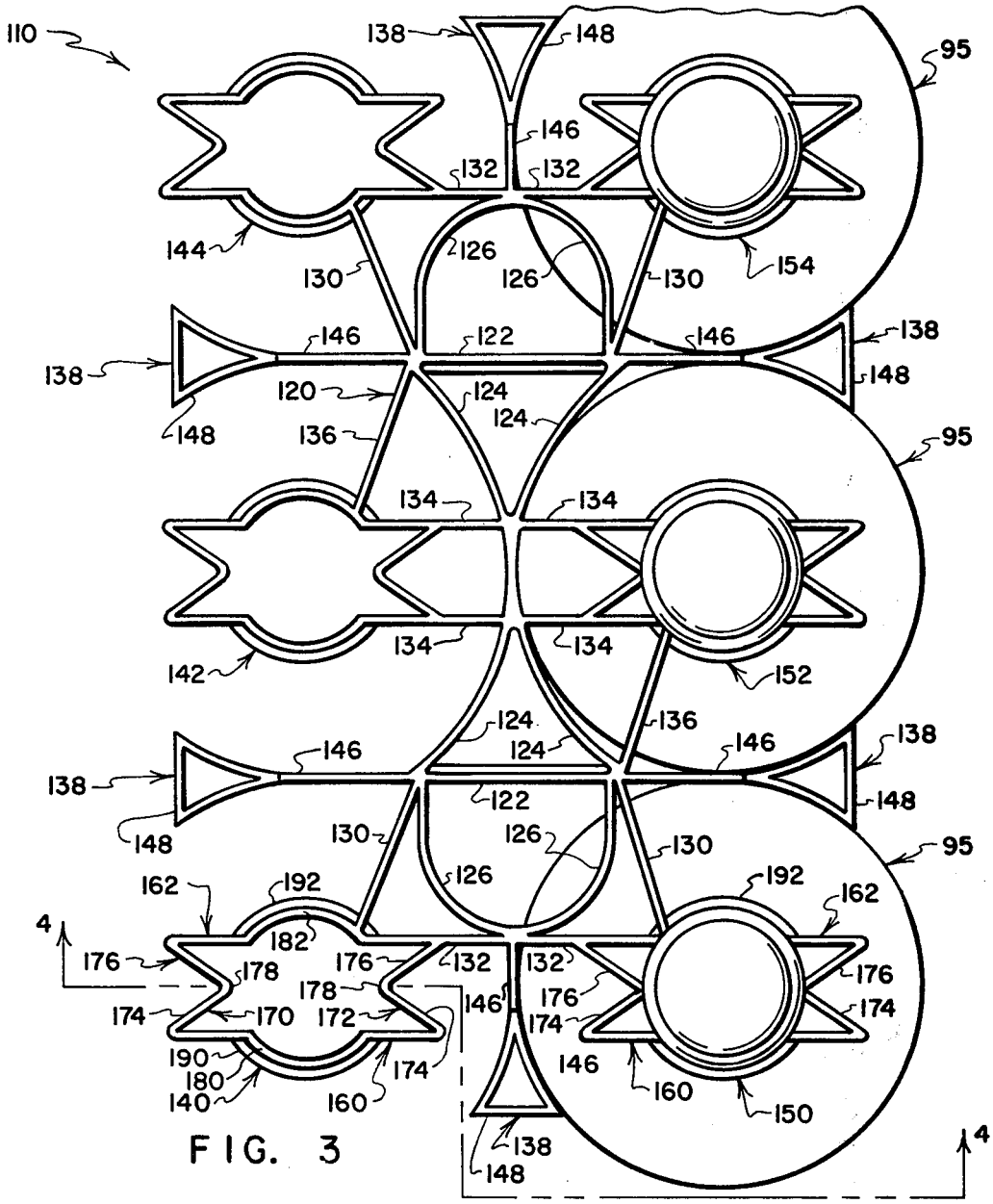
FIG. 3 is a top plan view of a second embodiment of carrier embodying features of the present invention, the carrier being shown engaging a row of three bottles.
Figure 4:
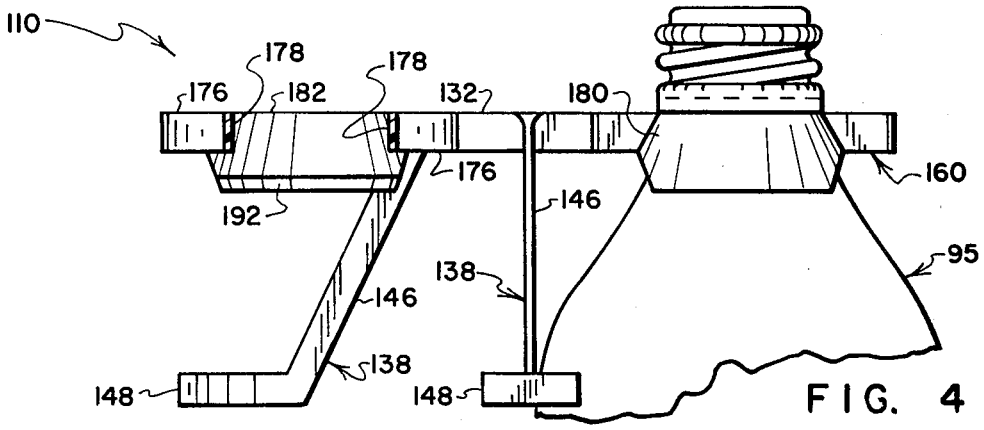
FIG. 4 is a sectional view as seen from planes indicated by the broken line 4—4 in FIG. 3.

Referring to FIGS. 3 and 4, a second embodiment of bottle carrier is indicated generally by the numeral 110. The carriers 10, 110 are identical except for the presence on the carrier 110 of stabilizer arms 138. Corresponding parts of the carriers 10, 110 are indicated by numerals which differ by the magnitude 100, and are not described here inasmuch as they are identical in form and function with the parts already described.

The stabilizer arms 136 each have stems 146 which depend from the plane of the bars 122, 124, 126, 130, 132, 134, 136 at angles of about 60 degrees, and have feet 148 which extend in a common plane which parallels the plane of the bars 122, 124, 126, 130, 132, 134, 136. The stems 146 and the feet 148 are arranged to extend between adjacent bottles 95 carried by the carrier 110. The feet 148 have a somewhat triangular configuration and serve to stabilize the bottles 95 and hold them together for transport.

Figure 5:
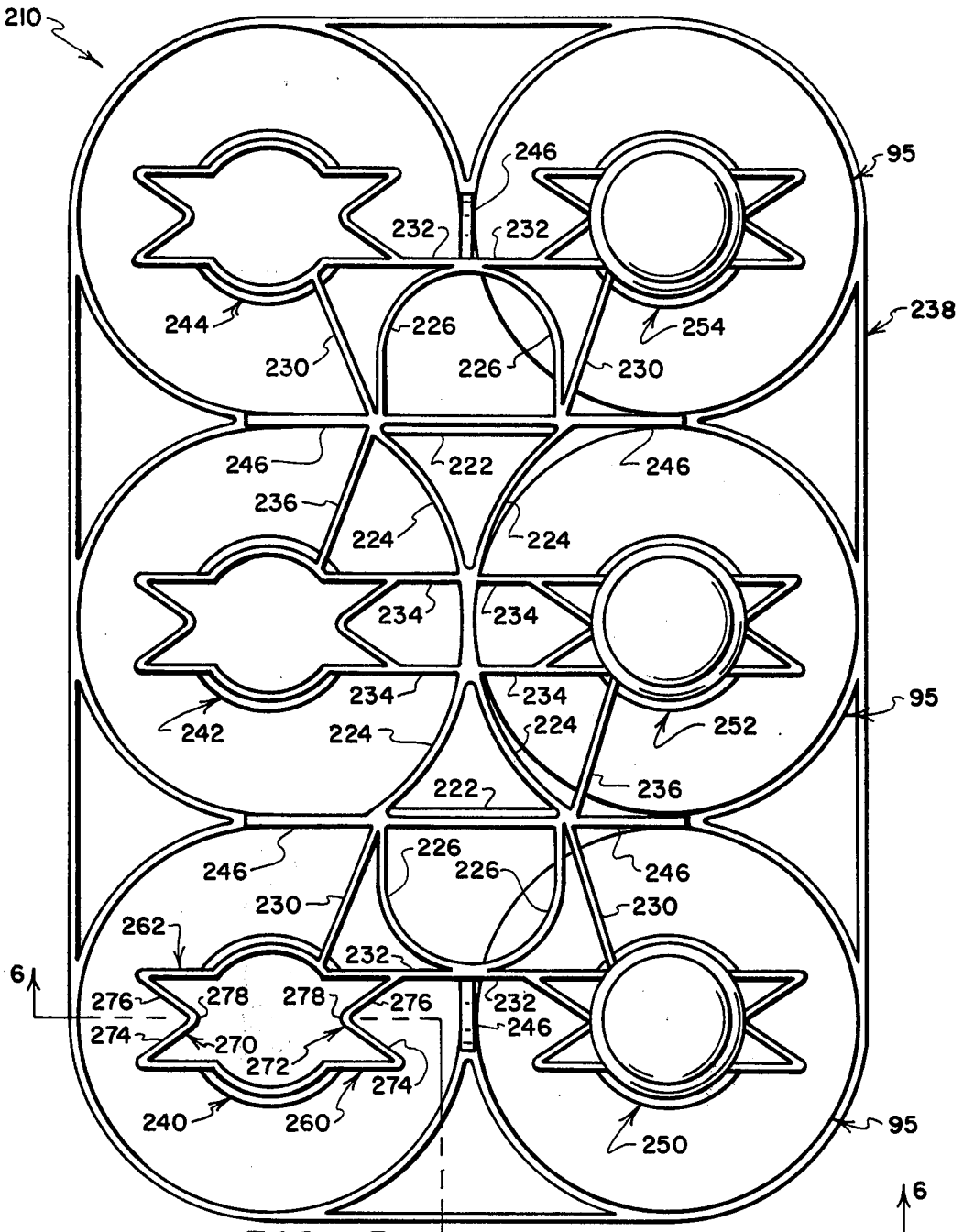
FIG. 5 is a top plan view of a third embodiment of a bottle carrier embodying features of the present invention, the carrier being shown engaging a row of three bottles.
Figure 6:
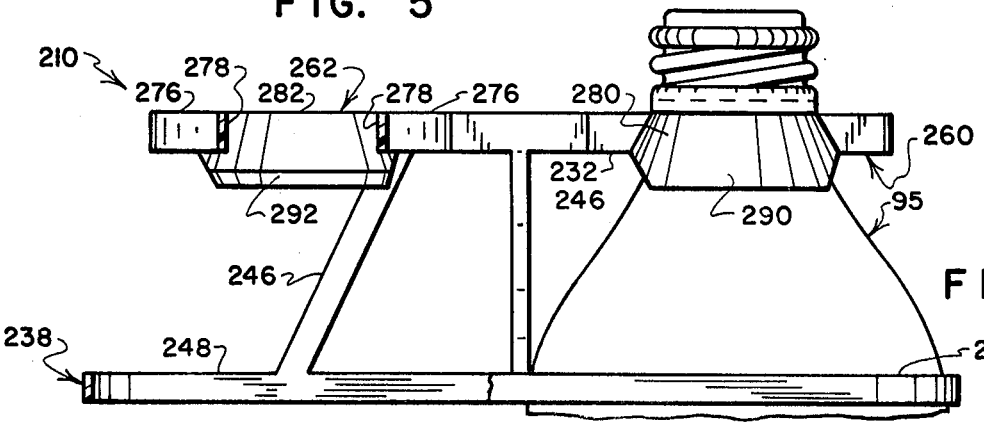
FIG. 6 is a sectional view as seen from planes indicated by a broken line 6—6 in FIG. 5.

Referring to FIGS. 5 and 6, a third embodiment of bottle carrier is indicated generally by the numeral 210. The carriers 10, 210 are identical except for the presence on the carrier 210 of a bottle retention skirt 238. Corresponding parts of the carriers 10, 210 are indicated by numerals which differ by the magnitude 200, and are not described here inasmuch as they are identical in form and function with the parts already described.

The material from which the carriers 10, 110, 210 are formed is preferably polypropylene or linear or high density polyethylene. Each of the carriers is a one-piece structure with all of its elements preferably formed substantially concurrently using injection molding techniques. The cross-sectional dimensions of the elements of the carriers 10, 110, 210 are selected to give a substantially rigid character to the carriers, while permitting their bottle-neck-receiving formations to flex as needed to receive and release cap-carrying bottle necks.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A one-piece bottle carrier made of relatively rigid plastics material and comprising:

(a) a plurality of bottle-neck-receiving formations each including an endless band defining a neck-receiving opening;

(b) each band having at least one W-shaped portion formed from two elongate inner leg portions each having first and second opposed end regions, the inner leg portions being interconnected at their first end regions and forming a "V" shaped projection which projects in a direction toward the center of its associated neck-receiving opening, and two outer leg portions each of which is connected to a separate one of the inner leg portions at the second end regions thereof, the configuration of each of the W-shaped portions serving to permit parts of its associated band to move relatively toward and away from each other (i) to enable cap-carrying portions of a bottle neck to be inserted through the opening; and, (ii) to grip bottle neck portions inserted through the opening;

(c) framework means for interconnecting the spaced neck-receiving formations to support the neck-receiving formations in a predetermined array; and, (d) the V-shaped projections being configured to engage neck portions of bottles inserted through associated ones of the neck-receiving openings, and to cooperate with other parts of the endless bands to securely releasably grip such bottle neck portions.

2. The carrier of claim 1 wherein each of the endless bands has a pair of said W-shaped portions located on opposite sides of its associated neck-receiving opening.

3. The carrier of claim 1 wherein portions of each endless band are provided with tapered surfaces configured to facilitate the insertion of a capped bottle neck into the neck-receiving opening.

4. A one-piece bottle-neck receiving formation for use with a bottle carrier, comprising an endless band defining a bottle-neck-receiving opening, the band having at least one W-shaped portion formed from two elongate inner leg portions each having first and second opposed end regions, the inner leg portions being interconnected at their first end regions and forming a "V" shaped projection which projects in a direction toward the center of its associated neck-receiving opening, and two outer leg portions each of which is connected to a separate one of the inner leg portions at the second end regions thereof, the configuration of the W-shaped portions serving to permit parts of the band to move relatively toward and away from each other as the W-shaped portion expands and contracts in the manner of an accordian as a cap-carrying bottle neck is inserted through the opening, the V-shaped projections being configured to engage neck portions of an inserted bottle and to cooperate with other parts of the endless bands to securely releasably grip such bottle neck portions.

5. The formation of claim 4 wherein the endless band has a pair of said W-shaped portions located on opposite sides of its associated neck-receiving opening.

6. The formation of claim 4 wherein portions of each endless band are provided with tapered surfaces configured to facilitate the insertion of a capped bottle neck into the neck-receiving opening.

7. A one-piece bottle carrier, comprising:

(a) a supporting framework including a plurality of bar-like members defining a plurality of openings;

(b) a plurality of bottle-neck-receiving formations each:

(i) including an endless band defining a bottle-neck-receiving opening;

(ii) having a portion thereof which is connected to the supporting framework;

(iii) having adjacent portions which are not connected to the framework, whereby the framework supports each of the bands in an ordered array without interfering with the ability of each band to change its shape as may be needed to accommodate the insertion of a bottle neck through its associated neck-receiving opening;

(c) each of the bands having at least one accordian-like formation with overlying parts which are relatively movable in the manner of an accordian to facilitate its associated neck-receiving-opening changing shape as needed to accommodate the insertion therethrough of a capped bottle neck; and (d) each of the accordian-like formations being of W-shape and formed from two elongate inner leg portions each having first and second opposed end regions, the inner leg portions being interconnected at their first end regions and forming a "V" shaped projection which projects in a direction toward the center of its associated neck-receiving opening, and two outer leg portions each of which is connected to a separate one of the inner leg portions at the second end regions thereof, the projections defined by the inner leg portions being configured to engage neck portions of bottles inserted through associated ones of the neck-receiving openings and to cooperate with other parts of the bands to securely releasably grip such bottle neck portions.

8. The carrier of claim 7 wherein the carrier is of substantially planar construction with all of its components extending substantially within a common plane.

9. The carrier of claim 7 additionally including bottle stabilizer means connected to the framework for stabilizing and holding together for transport such bottles as have their necks inserted through the neck-receiving openings.

10. The carrier of claim 9 wherein:

(a) the framework and the bottle-neck-receiving formations extend substantially within a common plane; and, (b) the bottle stabilizer means depend below said common plane.

11. The carrier of claim 10 wherein the bottle support formation means include stem portions which extend between adjacent ones of the bottles.

12. The carrier of claim 11 wherein the bottle support formation means include curved portions which at least partially perimetrically surround selected ones of the bottles.

13. The carriers of claim 12 wherein the curved portions define a skirt which extends about outer surfaces of all of such bottles as have their necks inserted through the neck-receiving openings.

14. The carrier of claim 7 wherein the bands have pointed upper formation means for underlying bottom edges of the skirts of caps carried on the necks of such bottles as are inserted through the neck-receiving openings.

* * * * *